US012352436B2

(12) United States Patent
Hamilton et al.

(10) Patent No.: US 12,352,436 B2
(45) Date of Patent: Jul. 8, 2025

(54) METHOD FOR CREMATION BY MEANS OF SUPERCRTITICAL FLUIDS REACTION

(71) Applicant: SCW Technologies Limited, Coleraine (GB)

(72) Inventors: Stephen W. Hamilton, Coleraine (GB); Gregory Scott Dawson, Olalla, WA (US)

(73) Assignee: SCW TECHNOLOGIES LIMITED, Colraine (GB)

( * ) Notice: Subject to any disclaimer, the term of this patent is extended or adjusted under 35 U.S.C. 154(b) by 0 days.

(21) Appl. No.: 18/690,213

(22) PCT Filed: Sep. 6, 2022

(86) PCT No.: PCT/IB2022/058347
§ 371 (c)(1),
(2) Date: Mar. 7, 2024

(87) PCT Pub. No.: WO2023/037229
PCT Pub. Date: Mar. 16, 2023

(65) Prior Publication Data

US 2024/0369220 A1 Nov. 7, 2024

(30) Foreign Application Priority Data

Sep. 9, 2021 (FR) ..... FR2109461

(51) Int. Cl.
*F23G 1/00* (2006.01)
*F23G 5/44* (2006.01)

(52) U.S. Cl.
CPC ..... *F23G 1/00* (2013.01); *F23G 5/44* (2013.01); *F23G 2900/7009* (2013.01)

(58) Field of Classification Search
None
See application file for complete search history.

(56) References Cited

FOREIGN PATENT DOCUMENTS

KR 20120085000 A * 7/2012
WO WO 9220965 A1 * 11/1992

* cited by examiner

*Primary Examiner* — Jason Lau
(74) *Attorney, Agent, or Firm* — Medlen & Carroll, LLP

(57) ABSTRACT

The present invention deals with a method for cremating a body comprising taking the body fluids to a supercritical state in order to act as a solvent capable of breaking down the tissues and bone of a corpse. The method allows creating a supercritical reaction with the body own fluids to break down all the tissues and bones of a body and convert them into ashen bone.

12 Claims, 3 Drawing Sheets

METHOD FOR CREMATION BY MEANS OF SUPERCRTITICAL FLUIDS REACTION

FIELD OF THE INVENTION

The present invention deals with a method for cremating a body comprised of taking the body's fluids to a supercritical state in order to act as a solvent capable of breaking down the tissue, organs and bone of a corpse.

The method allows for creating a supercritical reaction within the body's own fluids to break down all the organs, bones and tissue of a body and convert them into ashen bone.

BACKGROUND

Cremation has become an interesting alternative to traditional burial of human remains essentially because of pressing concerns over limited land availability and the increasing price of burial land. Cremation also displays the advantage of easing the funeral process compared to traditional burial which can encounter several tedious hurdles ensuing from embalming, permits, casket transportation and/or funeral service preparations including preparing the grave and purchasing the headstone.

Cremation corresponds to the process of reducing human remains to bone fragments and can be currently achieved by various technologies, especially by flame-based cremation and alkaline hydrolysis.

Traditional flame-based cremation uses flame and heat to reduce the human remains to bone fragments or cremated remains. In particular, flame-based cremation comprises the steps of placing a body in a vessel that is combustible, such as a casket appropriate for cremation or a rigid cardboard container, moving the vessel to a designed industrial furnace, referred to as cremation chamber or cremation furnace (also called a retort), wherein the body and the vessel are exposed to high temperatures, generally up to 2000° C., and are reduced to cremated remains. Hence, cremated remains essentially consists of bone fragments, any remains of the vessel and eventually any other by-products that may have been generated during the incineration process. After a cooling period, the cremated remains are retrieved from the cremation chamber to be inspected in order to collect any jewelries that have not inadvertently been taken off, metal remnants ensuing from the vessel used, dental filling materials and/or artificial joints surgically implanted during the life time of the deceased, such as hip replacements. The cremated remains are then ground down by a specific processor into the final resulting ashes which are then transferred and placed in an urn designed to be returned to the relatives of the deceased.

Even though flame-based cremation is more environmentally friendly than burial it still wields an environmental impact of its own as this process requires the implementation of fossil fuels to cremate the body and generates the release of large amounts of carbon dioxide into the atmosphere. Flame-based cremation can also be responsible in some cases for mercury emissions as a result of the presence of amalgam fillings.

Furthermore, human remains still need to be individually prepared before the implementation of a flame-based cremation process, especially before being moved to the cremation furnace. Indeed, implanted devices, such as pacemakers and/or medical devices, in particular those that are battery-operated, must be removed for safety reasons to avoid explosions that might occur during incineration in the cremation furnace.

In addition, flame-based cremation also exhibits the drawback that human cremated remains are commingled with the remains of the vessel and the eventual by-products triggered during the incineration. It bespeaks that a small amount of actual human cremated remains is effectively collected at the end of the flame-based cremation. As a result, when the relatives of the deceased take delivery of the urn, they do not know how much of the resulting ashes come from the cremated remains of the deceased.

Alkaline hydrolysis, also called liquid cremation, reduces the human remains to bone fragments or cremated remains through a process hinging on water and alkali, such as potassium hydroxide, and combining heat and pressure to streamline the natural decomposition of the body. This process yields to the production of bone fragments and a sterile liquid which may be recycled through the wastewater treatment system.

In particular, liquid cremation comprises the steps of placing a body in a vessel and moving the vessel to a designed cremation chamber which is filled with a mixture of water and alkali compounds, such as potassium hydroxide, at high temperature and pressure, wherein the body is decomposed. At the end of the liquid cremation process, bone fragments, corresponding to cremated remains, and a sterile liquid consisting of a mixture of water, salt, sugar and amino acids are obtained. The cremated remains are generally dried in order to be pulverized whereas the sterile liquid is drained. The cremated remains are then transferred and placed in an urn designed to be returned to the relatives of the deceased.

Thus, liquid cremation displays the assets of consuming less energy than traditional flame-based cremation and the produced sterile liquid can be easily recycled through the wastewater treatment system. Liquid cremation is also able to significantly curb carbon emission than flame-based cremation. It bespeaks that liquid cremation is more environmentally friendly than traditional flame-based cremation and its process has the advantage of being closer to what would happen if the body had been buried.

Moreover, liquid cremation allows yielding more human cremated remains than traditional flame-based cremation. In other words, a larger amount of human cremated remains can be retrieved and collected with liquid cremation than with classical flame-based cremation.

Contrary to traditional flame-based cremation, human remains do not require to be individually prepared as the implant devices do not need to be cut out from the body. In other words, due to the fact that liquid cremation involves lower temperatures than flame-based cremation, implant devices, such as pacemakers and artificial joint replacements, may be left in the body during its decomposition.

However, liquid cremation is a process that is not yet accepted and/or available in all countries which limits its public access. Indeed, liquid cremation can be perceived as a divisive process that is overall less dignified than standard flame-based cremation or traditional burial.

In addition, there can be limited providers available in countries where alkaline hydrolysis is accepted.

As a result, it remains a real need to provide a cremation method that is able to mitigate the several flaws occurring in the current available cremation methods.

In particular, one of the goals of the present invention is to provide a cremation method which consumes less energy and yields to larger amounts of cremated remains, more particularly human cremated remains, than standard flame-based cremation and is susceptible to be more accepted to the public than alkaline hydrolysis.

DESCRIPTION OF THE INVENTION

The present invention namely pertains to a method for cremating human remains comprising successively:

i) pre-heating a cremation chamber at a temperature of at least 300° C., ii) inserting said human remains into the cremation chamber, iii) sealing the cremation chamber, iv) increasing the pressure of the cremation chamber to a pressure above or equal to 2900 psi in order to take the body fluids of the human remains to a supercritical state, v) purging the cremation chamber once the bones and tissues of the human remains have been broken down by the body fluids at a supercritical state.

The method of the present invention makes it possible to take the body fluids of the human remains to a supercritical state thanks to the temperature and the pressure inside the cremation chamber in order to act as a solvent that is capable of breaking down the tissues and bones of said human remains.

As a result, the method according to the invention allows to take the body fluids at a temperature and pressure beyond their critical points so that said fluids cannot be classified as liquid nor vapor.

In particular, the breaking down of the tissues and bones is achieved by the body fluids of the corpse that had been brought to a supercritical state.

It bespeaks that the method does not require the addition or injection of water or any oxidation catalyst.

Especially, the method according to the present invention is different from a supercritical water process as it is based on using the dead body's own fluids brought to a supercritical state.

The present method relies on creating a supercritical reaction in all the body fluids of the deceased body in order to ensure the breakdown of the tissues and bones of the corpse placed inside the cremation chamber.

The method of the present invention enables to consume less energy and yields to larger amounts of human cremated remains than standard flame-based cremation.

As a result, the method of the present invention remains environmentally friendly as the process is able to curb the implementation of fuels and scale back carbon emissions as well as mercury emissions.

The method of the present invention also displays the advantage of not having to prepare the body before moving it to the cremation chamber by cutting out implant devices, such as pacemakers and artificial joint replacements. Indeed, human remains can be inserted as such into the cremation chamber.

Furthermore, said method allows reducing the dead body into bone fragments and a supercritical fluids mixture in a time period of less than two minutes, preferably less than one minute.

Hence, the method of the present invention allows collecting human cremated remains in an efficient manner under safe conditions.

The process allows a swift reaction to reduce with ease human remains into human cremated remains.

The cremated human remains obtained from the aforementioned method can then be pulverized, transferred and collected in an urn or any appropriate receptacle.

The process allows collecting larger amounts of human cremated remains in the final receptacle than traditional flame-based cremation.

In particular, the human cremated remains obtained from the method is not commingled with any materials coming from the vessel in which the human remains have been placed and/or any other by-products.

The method of the present invention exhibits the assets of being a flameless method.

Other subjects and characteristics, aspects and advantages of the invention will emerge even more clearly on reading the description, the figures and the examples that follow.

In the text herein below, and unless otherwise indicated, the limits of a range of values are included in that range, in particular in the expressions "between" and "ranging from . . . to . . . ".

Moreover, the expression "at least one" used in the present description is equivalent to the expression "one or more".

Furthermore, according to the present invention, the terms "human remains" can indifferently correspond to the terms "dead body", "corpse", "cadaver", "deceased body" and/or "carcass". In other words, the terms "human remains" can indifferently designate the terms "dead body", "corpse", "cadaver", "carcass", "deceased body" and "human remains" in the context of the present invention.

It bespeaks that the aforementioned method also purports to a method for cremating a corpse, a dead body, a cadaver, a deceased body or a carcass.

The term "human remains" can refer to a part of the deceased body or the whole deceased body.

Method

Preferably, the step of pre-heating the cremation chamber is performed at a temperature of at least 320° C., more preferably at a temperature of at least 340° C., even more preferably at a temperature of at least 370° C., and especially at a temperature of at least 374° C.

Preferably, the step of pre-heating the cremation chamber is performed at a temperature ranging from 300° C. to 420° C., more preferably ranging from 340° C. to 4000° C. and even more preferably ranging from 370° C. to 380° C.

Preferably, the step of pre-heating is performed with heating elements, especially heater rods or a bespoke build of nickel chrome resistance wire, more preferably heater rods, comprised within the cremation chamber.

In a preferred embodiment, the method comprises a step of pre-heating the cremation chamber at the aforementioned temperature, wherein said cremation chamber comprises an internal insulated chamber preferably containing heating elements, especially heater rods.

Preferably, human remains are placed in a casket appropriate for cremation or a rigid cardboard container, more preferably a casket, before being moved to the cremation chamber.

Preferably, human remains are placed into a basket before being moved to the cremation chamber. In particular, the basket is sized to contain a deceased body.

The human remains are then inserted into said cremation chamber.

The cremation chamber is then sealed, in particular hermetically sealed.

The method comprises increasing the pressure of the cremation chamber to a pressure above or equal to 2900 psi (corresponding to about 20 MPa) in order to take the body fluids of the human remains to a supercritical state.

In particular, the cremation chamber is pressurized to take the body fluids to a state that is different from a liquid or vapor state.

That it is to say that the cremation chamber is pressurized to a pressure sufficient to transform the body fluids of the corpse into a supercritical fluid.

In a preferred embodiment, the pressure of said cremation chamber is increased to a pressure above or equal to 3400 psi (about 24.44 MPa), more preferably above or equal to 3800 psi (about 26.2 MPa).

Especially, the pressure of said chamber ranges from 2900 psi (about 20 MPa) to 4500 psi (31.03 MPa), preferably from 3400 psi (about 24.44 MPa) to 4500 psi (31.03 MPa) and more preferably from 3800 psi (about 26.2 MPa) to 4500 psi (31.03 MPa).

In a preferred embodiment, the pressure of the cremation chamber is increased to a pressure above or equal to 2900 psi (about 20 MPa) in order to take the body fluids of the corpse to a supercritical state is performed for a period time of less than 5 minutes, in particular less than 4 minutes and even more preferably less than 2 minutes.

In other words, the cremation chamber is preferably pressurized for a period of time of less than five minutes, in particular for a period of time of less than four minutes.

In particular, at this stage of the method, the temperature and pressure of the body fluids are higher than their critical points allowing them to be transformed into a supercritical fluid.

In particular, the temperature at which the chamber has been pre-heated is kept during the step of increasing the pressure of the cremation chamber to a pressure above or equal to 2900 psi.

In other words, the cremation chamber is pressurized to a pressure above or equal to 2900 psi at a temperature at which the cremation chamber has been pre-heated.

As a result, the body is processed at the temperature at which the cremation chamber has been pre-heated.

In a preferred embodiment, the method comprises a step of increasing the pressure of the cremation chamber to a pressure above or equal to 2900 psi (about 20 MPa), preferably above or equal to 3400 psi (about 24.44 MPa), more preferably above or equal to 3800 psi (about 26.2 MPa), and the temperature of said cremation chamber is at least 300° C., preferably at least 320° C., more preferably at least 340° C., even more preferably at least 370° C., and especially at least 374° C.

In particular, the method comprises a step of increasing the pressure of the cremation chamber to a pressure above or equal to 3400 psi (about 24.44 MPa), more preferably above or equal to 3800 psi (about 26.2 MPa), and the temperature of said cremation chamber is at least 320° C., more preferably at least 340° C., even more preferably at least 370° C., and especially at least 374° C.

More preferably, the method comprises a step of increasing the pressure of the cremation chamber to a pressure above or equal to 3400 psi (about 24.44 MPa) and the temperature of said cremation chamber is at least equal to 374° C.

According to the present invention, the feature "body fluids" encompasses water, free-flowing blood, blood components and any body fluids contained in a corpse or a dead body.

Preferably, the step of increasing the pressure of the cremation chamber to a pressure above or equal to 2900 psi (about 20 MPa) is performed either with compressed air or nitrogen, more preferably nitrogen.

In particular, the content of oxygen within compressed air can be up to 6% in volume relative to the total volume of said compressed air.

Preferably, the step of increasing the pressure of the cremation chamber to a pressure above or equal to 2900 psi (about 20 MPa) is performed with nitrogen or a gas containing more than 95% in volume of nitrogen relative to the total volume of said gas in order to ensure the bodies fluid content does not boil nor burn.

Preferably, the step of increasing the pressure of the cremation chamber to a pressure above or equal to 3400 psi (about 24.44 MPa) is performed with nitrogen or a gas containing more than 95% in volume of nitrogen relative to the total volume of said gas.

As previously detailed, once the body fluids are taking to a supercritical state, they act as a solvent capable of breaking down the tissues and bones of the corpse inside the cremation chamber.

In particular, the body fluids at a supercritical state are able to break down the molecular chains of the tissues and bones of the deceased body as they act as a solvent.

The reaction leads to the formation of bone fragments, corresponding to human cremated remains (also referred to as ashen bones), and a supercritical fluid mixture wherein the body fluids and the tissues are commingled.

The reaction can advantageously last less than two minutes, preferably less than one minute.

Once the reaction is complete, that is to say when the tissues and the bones of the dead body are entirely broken down, the cremation chamber is purged, especially with air.

The step of purging the cremation chamber once the reaction is achieved can be repeated several times.

Preferably, once the cremation chamber has been purged, especially with air, the supercritical fluid mixture resulting from the reaction between the body fluids at a supercritical state and the tissues are drained and especially pushed through in a heat exchanger.

In other words, at the end of the reaction, the supercritical fluid consists of a mixture of body fluids and tissues.

Preferably, the method comprises draining and pushing through said supercritical fluid to a heat exchanger after purging the cremation chamber.

Preferably, the step of purging is performed by opening a pre-set pressure relief valve of the cremation chamber and the supercritical fluid mixture resulting from the reaction between the body fluids at a supercritical state and the tissues are drained, especially pushed through in a heat exchanger and into a holding tank.

The method preferably comprises cooling back said supercritical fluid mixture to a liquid state in the heat exchanger.

Especially, the liquid issued from the heat exchanger has a pH value lower than 7 with no DNA signature.

Once the cremation chamber has been purged, the pressure, in particular the remaining pressure, is scaled back and said cremation chamber can safely be opened.

The method preferably comprises collecting the bone fragments or the human cremated remains.

The human cremated remains can be pulverized in order to reduce the size of the bone fragments.

The human cremated remains can then be collected and transferred into an urn or any appropriate container.

In other words, after purging the cremation chamber, the pressure in said chamber is released, and the human cremated remains are collected.

Cremation Chamber

The method of the present invention is preferably implemented in a cremation chamber as defined hereafter.

The cremation chamber used in the present invention can present an oblong shape, preferably a cylinder shape, and is more preferably a hollow tube.

The cremation chamber can be made of metal, such as stainless steel, nickel-based alloys, in particular nickel-based alloys sold under the trademark name Inconel®, or in any other high-performance alloys used in high temperature applications.

The cremation chamber preferably comprises heating elements, especially heater rods, in order to pre-heat said chamber at a temperature of at least 300° C., at a temperature of at least 320° C., more preferably at a temperature of at least 340° C., even more preferably at a temperature of at least 370° C., and especially at a temperature of at least 374° C.

Preferably, the cremation chamber comprises an internal insulated chamber having the same shape as the cremation chamber. Especially, the internal insulated chamber has an oblong shape, preferably a cylinder shape, and is more preferably a hollow tube.

The internal insulated chamber preferably forms at least a part of the interior of the cremation chamber.

Preferably, the cremation chamber has a width higher than the one of the internal insulated chamber.

The internal insulated chamber can be made of ceramic or coated with ceramic, especially high-temperature resistant ceramic, such as high density ceramic insulation.

The internal insulated chamber is suitable to receive human remains, especially a casket appropriate for cremation, a rigid cardboard container and/or a basket containing said human remains, especially a corpse.

In a preferred embodiment, the internal insulated chamber is suitable to receive a basket, especially a stainless-steel mesh basket. The basket is preferably reusable.

A basket, especially a stainless-steel mesh basket, is preferred in order to retrieve only the deceased ashes.

The internal insulated chamber preferably comprises heating elements, especially heater rods, in order to pre-heat the cremation chamber at the aforementioned temperature.

The presence of heating elements, preferably heater rods, within an internal insulated chamber in the cremation chamber has the advantage of reducing energy costs in heating and retaining heat within said internal insulated chamber and allowing to use lower temperature door seals.

The cremation chamber can incorporate an inward swinging door which will preferably be unable to open while the chamber is in a pressurized condition.

FIG. 1 represents a top view of a cremation chamber 1 according to the invention having an oblong shape.

FIG. 2 represents a side view of the cremation chamber 1 according to the invention having an oblong shape.

FIG. 3 represents a sectional view along the III-III axis of the cremation chamber 1 according to the invention.

FIG. 4 represents a sectional view along the IV-IV axis of the cremation chamber 1 of the invention.

Figure 1:
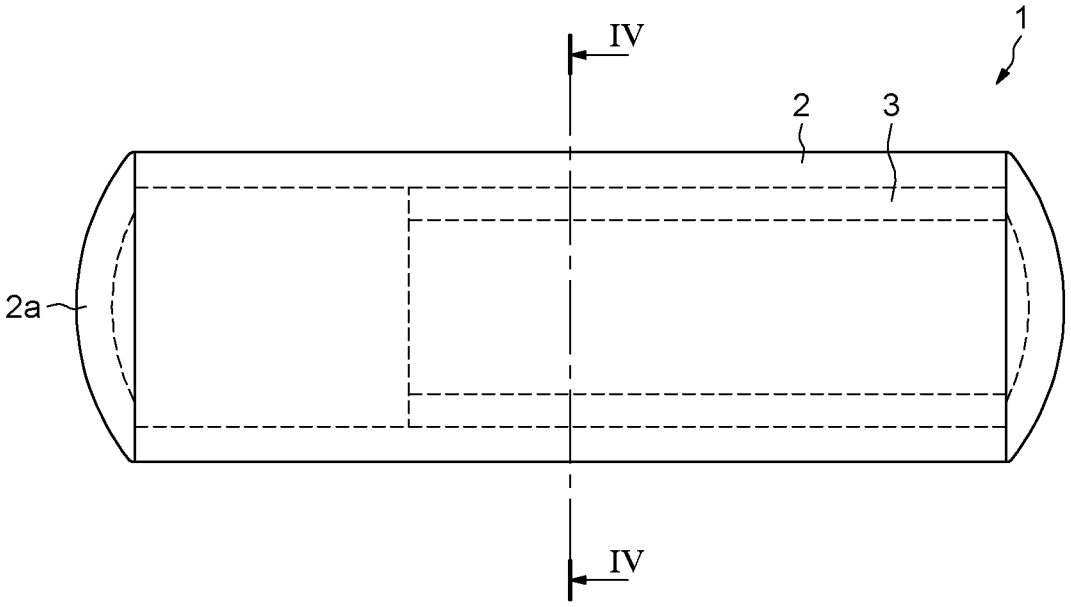
FIGS. 1, 2, 3 and 4 illustrate one embodiment of the cremation chamber of the present invention.

According to FIG. 1, the cremation chamber 1 is a hollow tube providing with an outer casing 2 and containing an internal insulating chamber 3, preferably made of ceramic that is able to withstand high temperatures, such as 420° C.

The length of the outer casing 2 is higher than the length of the internal insulated chamber 3.

The cremation chamber 1 and the internal insulated chamber 3 are sized to receive a cadaver whether it is contained in a basket, a casket or a rigid cardboard container, preferably a basket.

Figure 2:
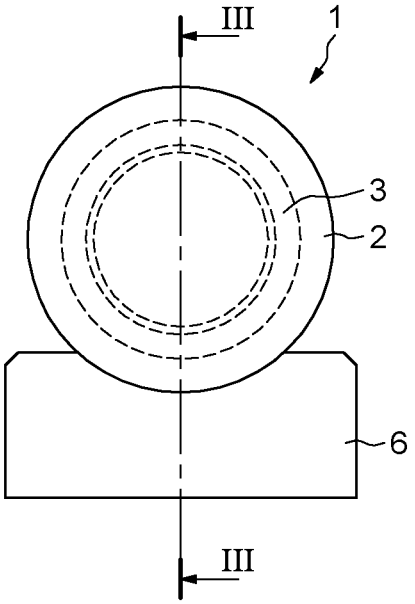

According to FIG. 2, the external envelope 2 has a diameter higher than the diameter of the internal insulated chamber 3.

Figure 3:
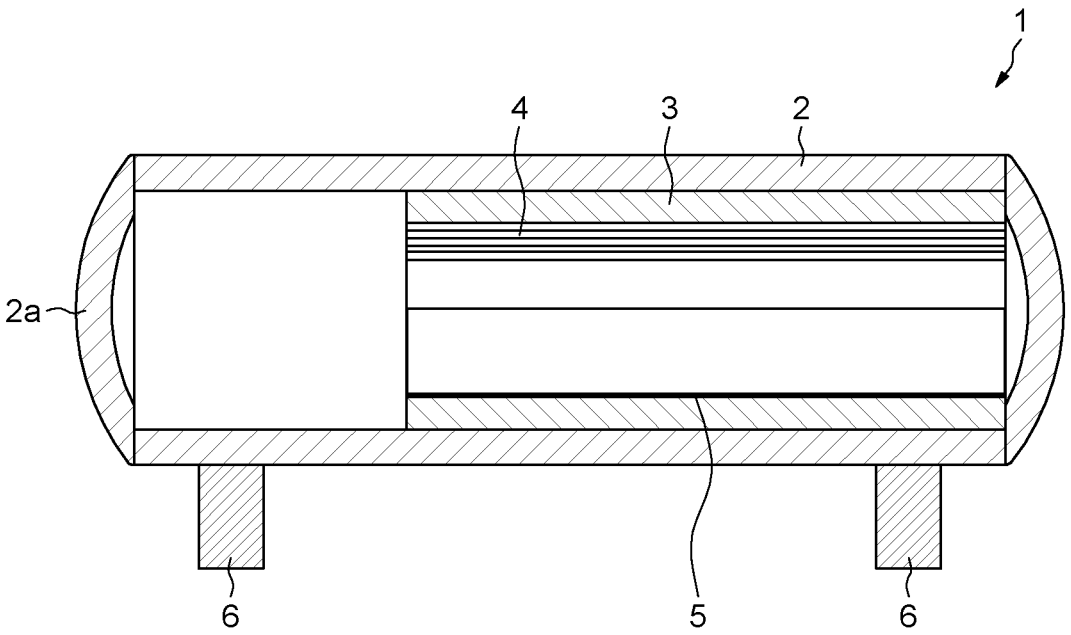

Referring now to FIG. 3, the internal insulated chamber 3 comprises heating rods 4 in order to pre-heat said insulated chamber 3 at the aforementioned temperature, preferably at a temperature of at least 320° C., more preferably at a temperature of at least 374° C.

The heating rods 4 are placed near the ceiling of the internal insulated chamber 3 and are preferably arranged equidistant.

The internal insulated chamber 3 comprises a basket 5 sized to contain a cadaver (not represented).

The basket 5 is placed on the floor of the internal insulated chamber 3.

Temperature probes (not represented) can be present on the surface the outer casing 2 and are suitable to alert the operator when the cremation chamber 1 reaches the required temperatures and to allow for temperature drop when the door of the cremation chamber 1 is open and the basket 4 is removed.

Figure 4:
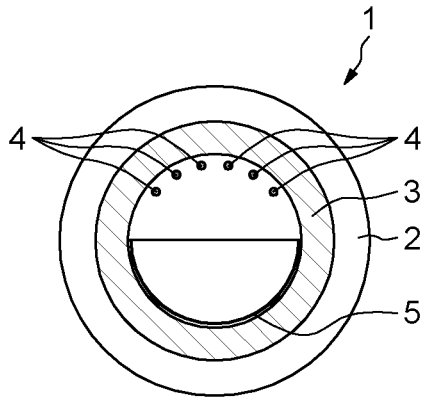

According to FIG. 4, the width of the external envelope 2 is higher than the width of the internal insulated chamber 3.

Figure 5:
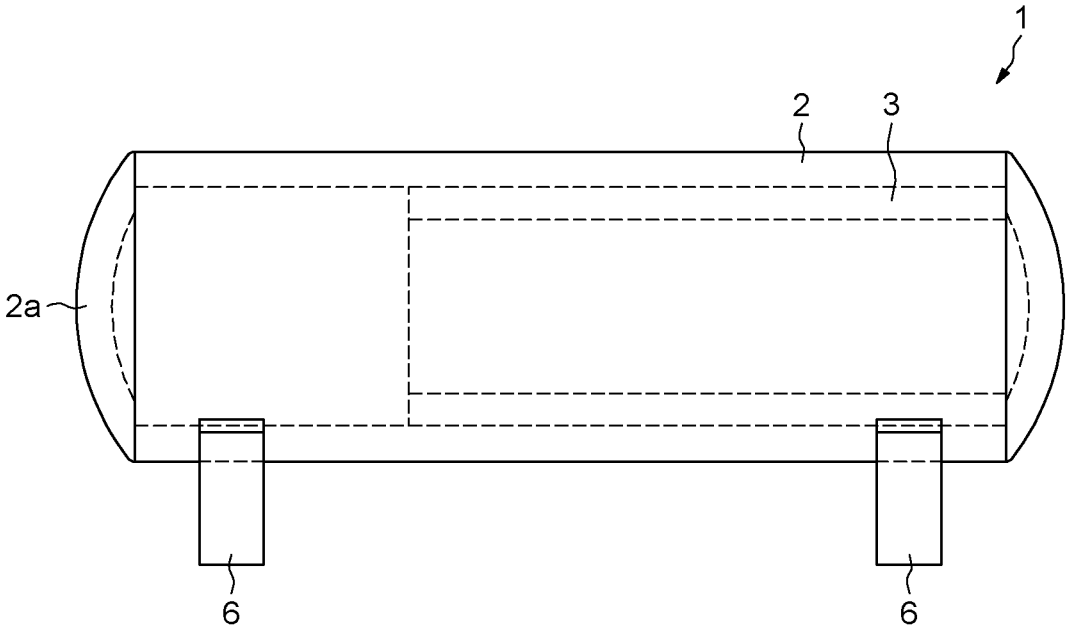
FIG. 5 represents a front view of the cremation chamber 1 according to the invention.

According to FIG. 5, the cremation chamber 1 can be mounted on a support comprising legs 6 and optionally a skid (not represented). The legs 6 can optionally be provided with lifting brackets (not represented).

Especially when implementing the method of the present invention, the heater rods 4 placed near the ceiling of the interior insulated chamber 3 are turned on, with an empty basket 5 in position to retain and isolate the heat within the inner chamber 3.

Once the required temperature of at least 300° C. is reached, the door 2*a* is opened, the empty basket 5 removed and replaced with a basket 5 containing a corpse. The door 2*a* is then closed and sealed, then the chamber 1 is pressurized up to 2900 psi.

As the bodies fluid enters a supercritical state the chamber 1 pressure will increase, the pressure can build for example to 4,000 psi with the control excess bleed off through a pressure relief valve set up at the outlet of the heat exchanger.

During the supercritical fluid process the pressure is preferably gradually reduced, this is due to the overall solid volume (deceased body) within the chamber reducing in size as the fluid cleaves the molecular chains.

The invention claimed is:

1. A method for cremating remains, comprising successively:

i) pre-heating a cremation chamber (1) at a temperature of at least 300° C., ii) inserting said remains into the cremation chamber (1), iii) sealing the cremation chamber (1), iv) increasing the pressure of the cremation chamber (1) to a pressure above or equal to 2900 psi (20 MPa) in order to take the body fluids of the remains to a supercritical state, v) purging the cremation chamber (1) once the bones and tissues of the remains, have been broken down by the body fluids at a supercritical state, wherein the method does not include the addition or injection of water or an oxidation catalyst.

2. The method according to claim 1, characterized in that the step of pre-heating the cremation chamber (1) is performed at a temperature of at least 320° C., more preferably at a temperature of at least 340° C. and even more preferably at a temperature of at least 370° C.

3. The method according to claim 1, characterized in that the step of preheating the cremation chamber (1) is performed with heating elements (4), especially heating rods (4).

4. The method according to claim 1, characterized in that the step of increasing the pressure of the cremation chamber (1) is performed at a pressure above or equal to 3400 psi, more preferably above or equal to 3800 psi (26.2 MPa).

5. The method according to claim 1, characterized in that the step of increasing the pressure is performed for a period of time of less than five minutes, preferably less than four minutes and even more preferably less than two minutes.

6. The method according to claim 1, characterized in that the step of increasing the pressure of the cremation chamber (1) is performed either with compressed air, nitrogen, or a gas containing more than 95% in volume of nitrogen relative to the total volume of said gas.

7. The method according to claim 1, characterized in that the cremation chamber (1) is purged with air.

8. The method according to claim 1, characterized in that, after purging the cremation chamber (1), the supercritical fluid mixture is drained.

9. The method according to claim 1, characterized in that the supercritical fluid mixture is pushed through a heat exchanger.

10. The method according to claim 9, characterized in that the supercritical fluid mixture is cooled back to a liquid state in the heat exchanger.

11. The method according to claim 1, characterized in that, after purging the cremation chamber (1), the pressure in said chamber (1) is released, and the cremated remains are collected.

12. The method according claim 1, wherein the remains are human remains.

* * * * *